US010294656B2

(12) United States Patent
Fox

(10) Patent No.: US 10,294,656 B2
(45) Date of Patent: May 21, 2019

(54) MULTIPLE PORT BEAM BRACKET

(71) Applicant: Fox Hardwood Lumber Company, L.L.C., Franklin, TN (US)

(72) Inventor: Samuel Fox, Franklin, TN (US)

(73) Assignee: FOX HARDWOOD LUMBER, LLC, Franklin, TN (US)

( * ) Notice: Subject to any disclaimer, the term of this patent is extended or adjusted under 35 U.S.C. 154(b) by 232 days.

(21) Appl. No.: 15/623,354

(22) Filed: Jun. 14, 2017

(65) Prior Publication Data

US 2018/0363287 A1 Dec. 20, 2018

(51) Int. Cl.

*E04B 1/24* (2006.01)
*E04B 1/26* (2006.01)
*E04B 1/58* (2006.01)

(52) U.S. Cl.

CPC ..... *E04B 1/2403* (2013.01); *E04B 1/2612* (2013.01); *E04B 1/5831* (2013.01); *E04B 2001/266* (2013.01); *E04B 2001/2644* (2013.01); *E04B 2001/2652* (2013.01); *E04B 2001/2676* (2013.01); *E04B 2001/2692* (2013.01); *E04B 2001/5887* (2013.01)

(58) Field of Classification Search

CPC .... E04B 1/2403; E04B 1/2612; E04B 1/5831; E04B 2001/2644; E04B 2001/2652; E04B 2001/266; E04B 2001/2676; E04B 2001/2692

See application file for complete search history.

(56) References Cited

U.S. PATENT DOCUMENTS 1,258,409 A * 3/1918 Hill ..... E04B 1/19 248/357
2,936,530 A * 5/1960 Bowen ..... G09B 25/04 403/171
3,097,730 A * 7/1963 Halle ..... E04B 1/2403 403/173
3,392,947 A * 7/1968 Keliehor ..... A47C 5/04 108/158.11
4,054,392 A * 10/1977 Oppenheim ..... F16B 7/18 403/175
4,398,841 A * 8/1983 Kojima ..... E04B 1/2604 403/173
8,864,096 B1 * 10/2014 Fox ..... E04H 12/2292 248/534

* cited by examiner

*Primary Examiner* — Daniel J Wiley
(74) *Attorney, Agent, or Firm* — Shane Cortesi

(57) ABSTRACT

A connection device for supporting a plurality of beams comprising a plate, a first side support and a second side support, with each side support including a top portion extending from the plate in a first direction and a bottom portion extending from the plate in a second direction substantially opposite the first direction. Included are a first guide and a second guide with each guide attaching to the plate and each side support. Each guide includes a top portion extending from the plate in the first direction and a bottom portion extending from the plate in the second direction. The plate, the top portion of each side support, and the top portion of each guide define a top cavity shaped to accept one of the beams. Further, the plate, the bottom portion of each side support, and the bottom portion of each guide define a bottom cavity shaped to accept one of the beams.

29 Claims, 21 Drawing Sheets

MULTIPLE PORT BEAM BRACKET

This is a Non-Provisional Patent Application filed by applicant Fox Hardwood Lumber Company L.L.C for the invention by Samuel Fox, a citizen of the United States, residing in Franklin, Tennessee for a "Multiple Port Beam Bracket."

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

All patents and publications described or discussed herein are hereby incorporated by reference in their entirety.

BACKGROUND OF THE INVENTION

The present invention relates generally to supports for beams or posts, and more particularly to a multiple port beam bracket for supporting a beam or post.

Various devices are known in the art that connect multiple support beams together to facilitate support of structures. Some of these prior art connection devices, or brackets, have attempted to facilitate the attachment between support features, such as support beams, used in the construction of a building, (e.g., a dwelling, home, office, barn, and the like), or even portions of a building. These prior art devices have failed to adequately allow for the installation of those brackets when multiple support beams are used, or when the support beams held by those brackets are of different materials. This is especially true for connection locations that are at the intersection of multiple support beams.

What is needed then, is a new connection device or bracket used for supporting a beam. This preferred device should facilitate the connection between multiple support beams or when the support beams are made of different materials. This preferred device should allow for easy installation of the support beam at the junction of the beams. This needed connection device is lacking in the art.

BRIEF SUMMARY OF THE INVENTION

Included herein is a connection device for supporting a plurality of beams comprising a plate, a first side support and a second side support, with each side support including a top portion extending from the plate in a first direction and a bottom portion extending from the plate in a second direction substantially opposite the first direction. Included are a first guide and a second guide with each guide attached to the plate and each side support. Each guide includes a top portion extending from the plate in the first direction and a bottom portion extending from the plate in the second direction. The plate, the top portions of each side support, and the top portions of each guide define a top cavity shaped to accept one of the beams. Further, the plate, the bottom portions of each side support, and the bottom portions of each guide define a bottom cavity shaped to accept one of the beams.

In an embodiment, the plate can include a plurality of plate openings and each side support can include a plurality of side support openings. The top portions of each side support can include at least two indented sides and the indentions on each side support are positioned, or can start, proximate either the first guide or the second guide. The bottom portions of each side support can include at least two indented sides and the indentions on each side support are positioned, or can start, proximate either the first guide or the second guide. Further, for each side support, the indented sides of the top portion of said side support can be longer than the indented sides of the bottom portion of said side support.

In an embodiment, a first set of first, second, and third side attachments can be included with each side attachment extend from one of the side supports in a direction substantially perpendicular to said side support and forming a first side connection area. A second set of first, second, and third side attachments can be included with each side attachment extending from the other side support in a direction substantially perpendicular to said side support and forming a second side connection area.

In another embodiment, the second set of first, second, and third side attachments can be alternately positioned with each side attachment extending from one of the guides in a direction substantially perpendicular to said guide and forming a second side connection area. A third set of first, second, and third side attachments can be included with each side attachment extending from the other guide in a direction substantially perpendicular to said side guide and forming a third side connection area. A fourth set of first, second, and third side attachments can be included with each side attachment extending from the other side support in a direction substantially perpendicular to said side support and forming a fourth side connection area.

It is therefore a general object of the current disclosure to provide a connection device for support beams.

Another object of the current disclosure is to provide a connection device that facilitates attachment between various beams where the beams are constructed of different materials.

Another object of the present disclosure is to provide a support bracket that is both functional and aesthetically appealing.

Other and further objects, features and advantages of the present disclosure will be readily apparent to those skilled in the art upon reading of the following disclosure when taken in conjunction with the accompanying drawings.

DETAILED DESCRIPTION OF THE INVENTION

Figure 1:
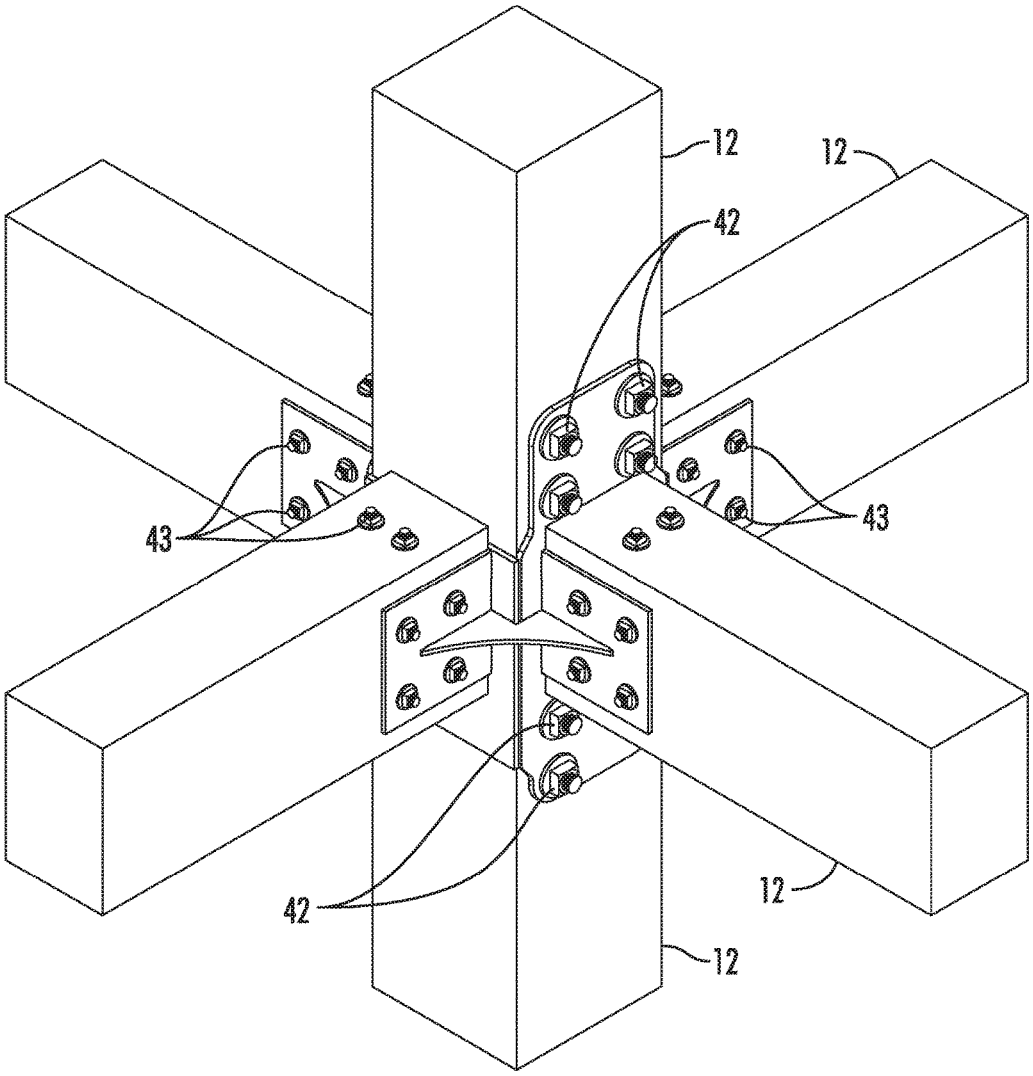
FIG. 1 is a perspective view of a connection device made in accordance with the current disclosure shown supporting multiple beams.
Figure 2:
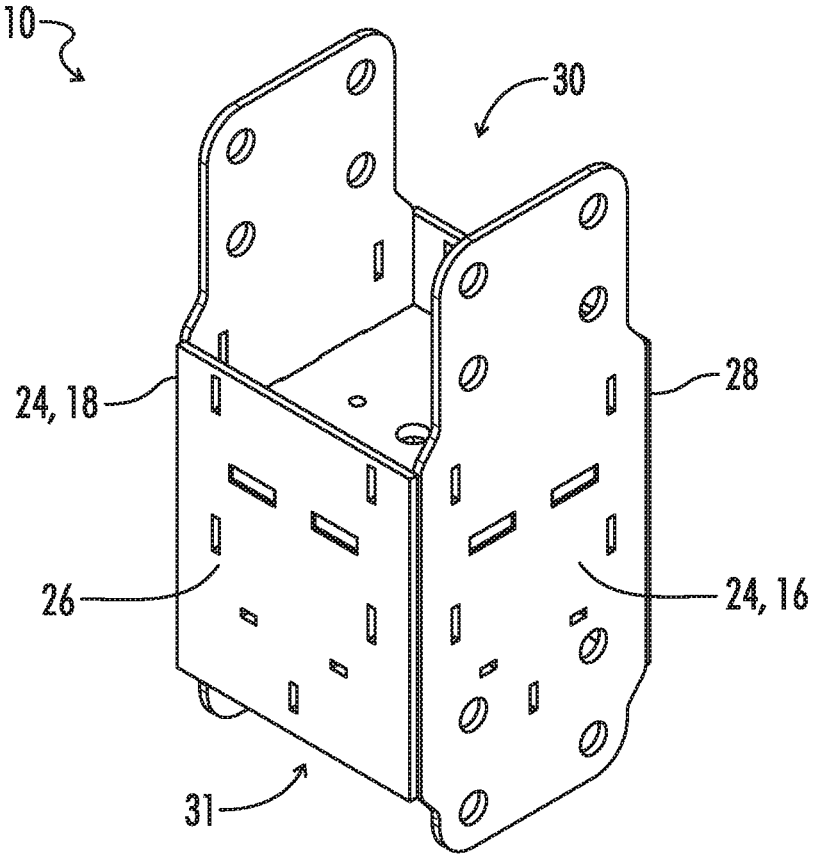
FIG. 2 is a perspective view of a connection device made in accordance with the current disclosure.
Figure 2A:
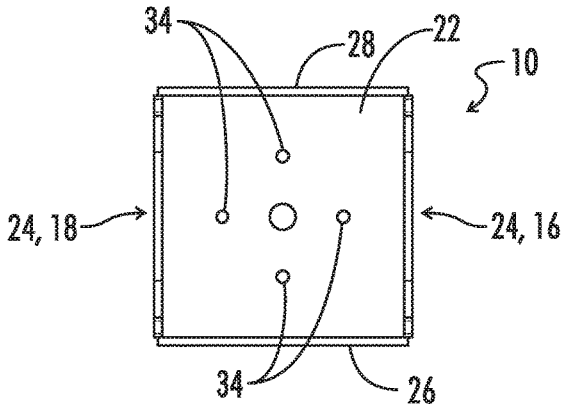
FIG. 2A is a top view of the connection device shown in FIG. 2.
Figure 2B:
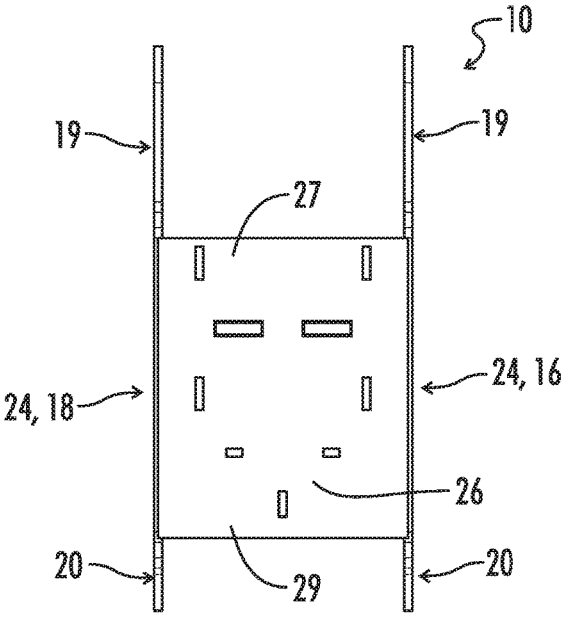
FIG. 2B is a front view of the connection device shown in FIG. 2.
Figure 2C:
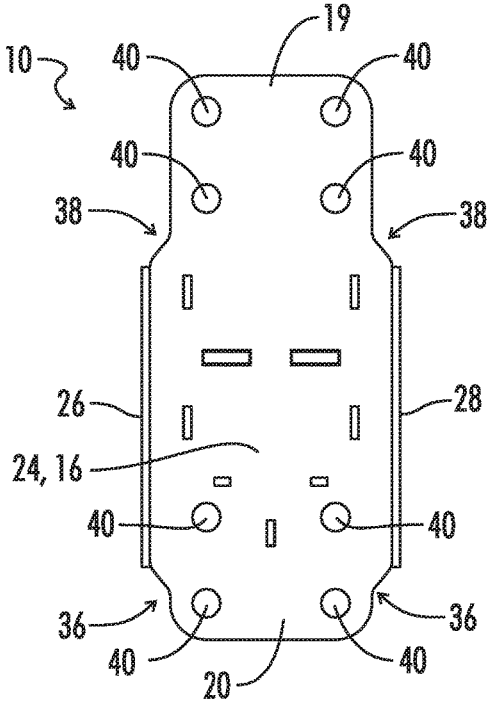
FIG. 2C is a side view of the connection device shown in FIG. 2.
Figure 3:
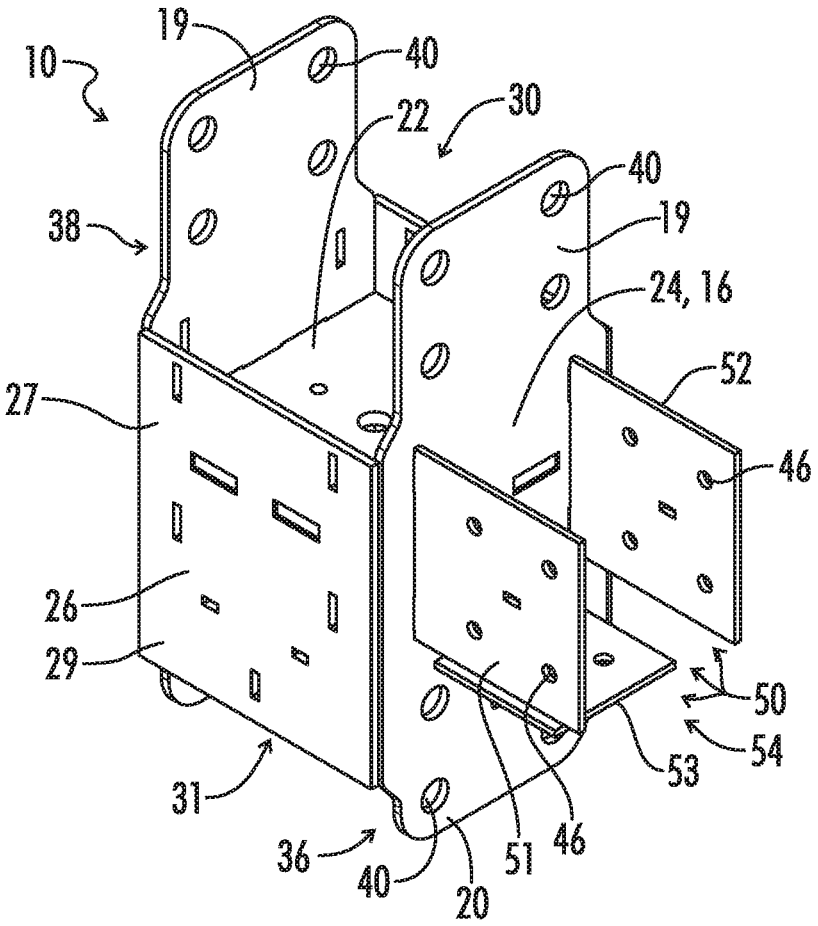
FIG. 3 is a perspective view of a connection device made in accordance with the current disclosure and having a side connection area.
Figure 3A:
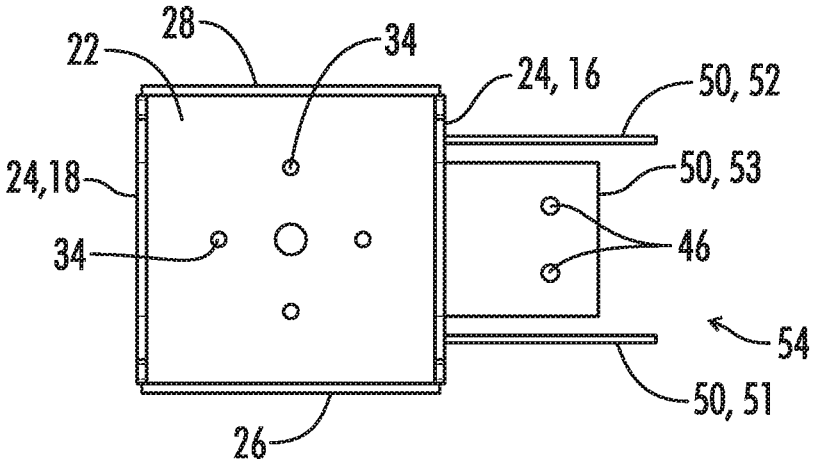
FIG. 3A is a top view of the connection device shown in FIG. 3.
Figure 3B:
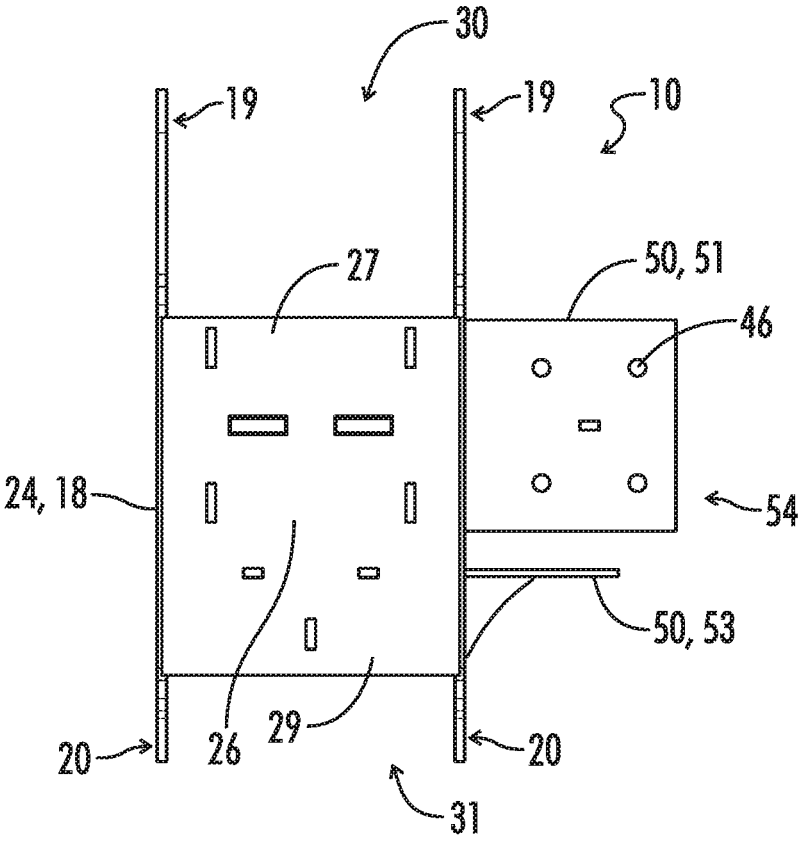
FIG. 3B is a front view of the connection device shown in FIG. 3.
Figure 3C:
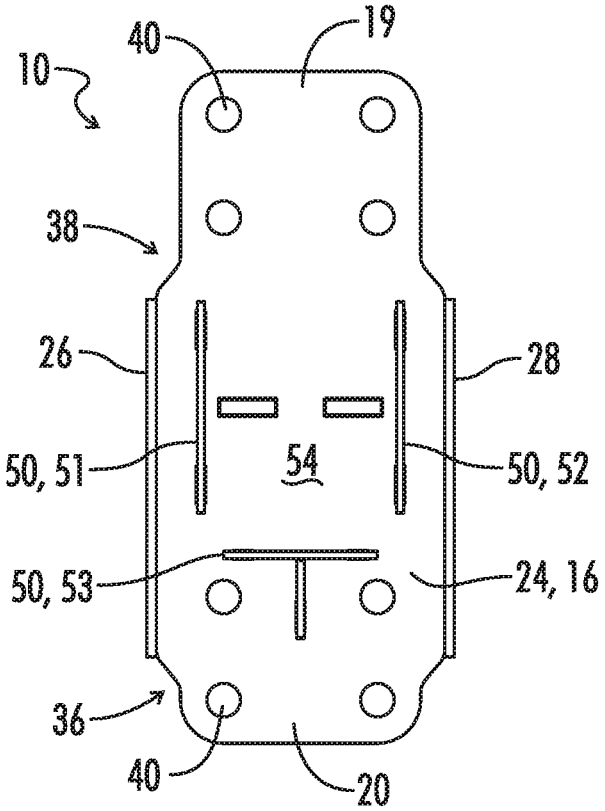
FIG. 3C is a side view of the connection device shown in FIG. 3.
Figure 4:
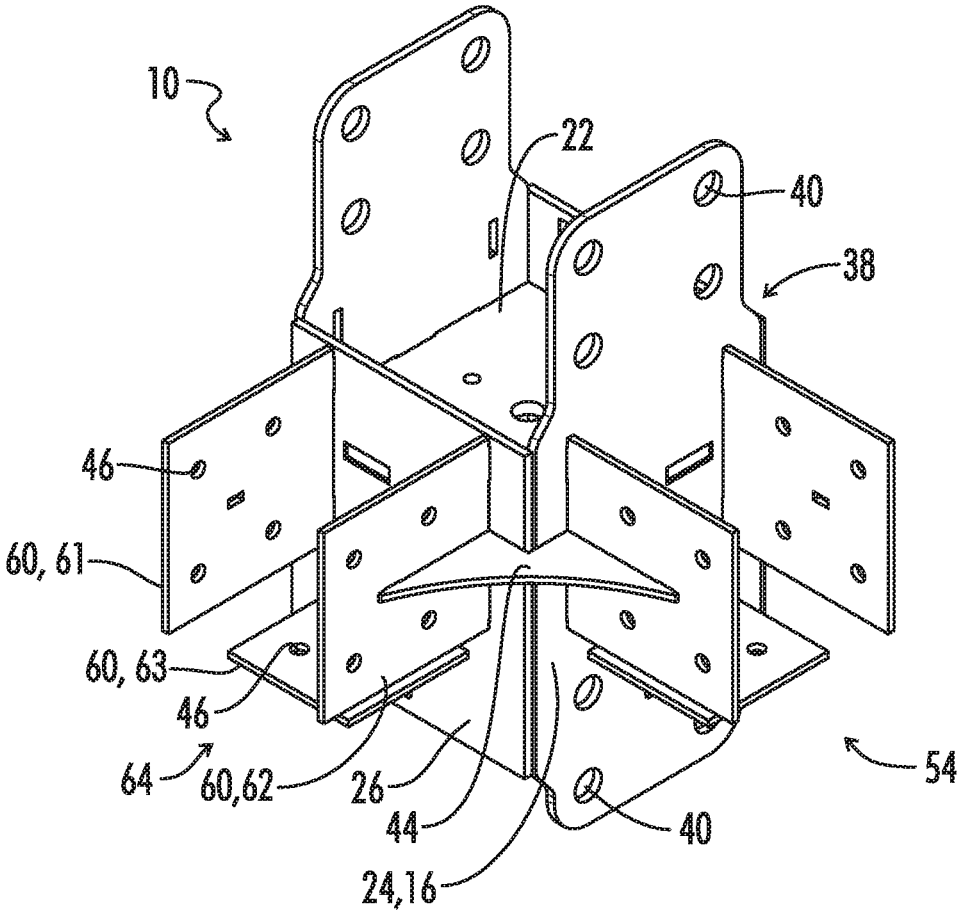
FIG. 4 is a perspective view of a connection device made in accordance with the current disclosure and having two side connection areas.
Figure 4A:
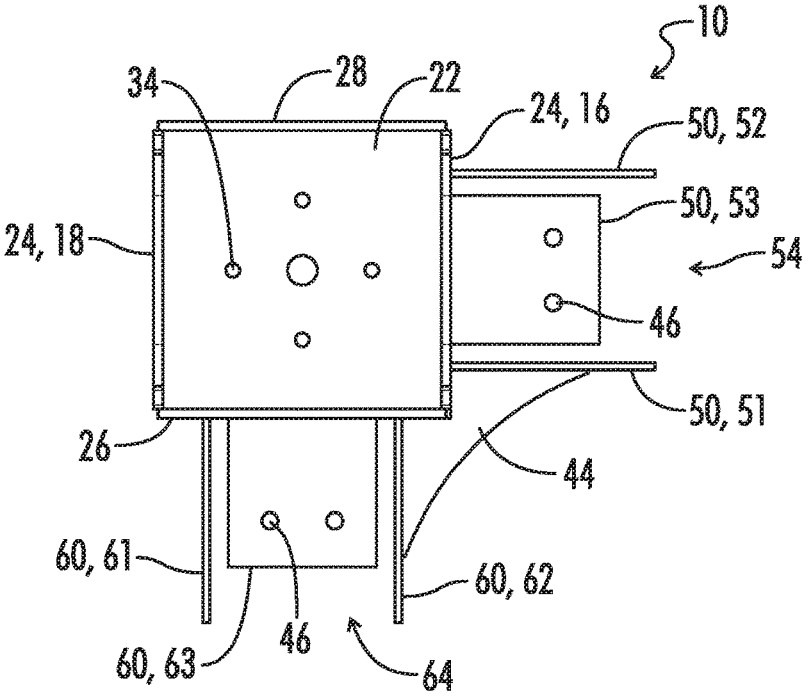
FIG. 4A is a top view of the connection device shown in FIG. 4.
Figure 4B:
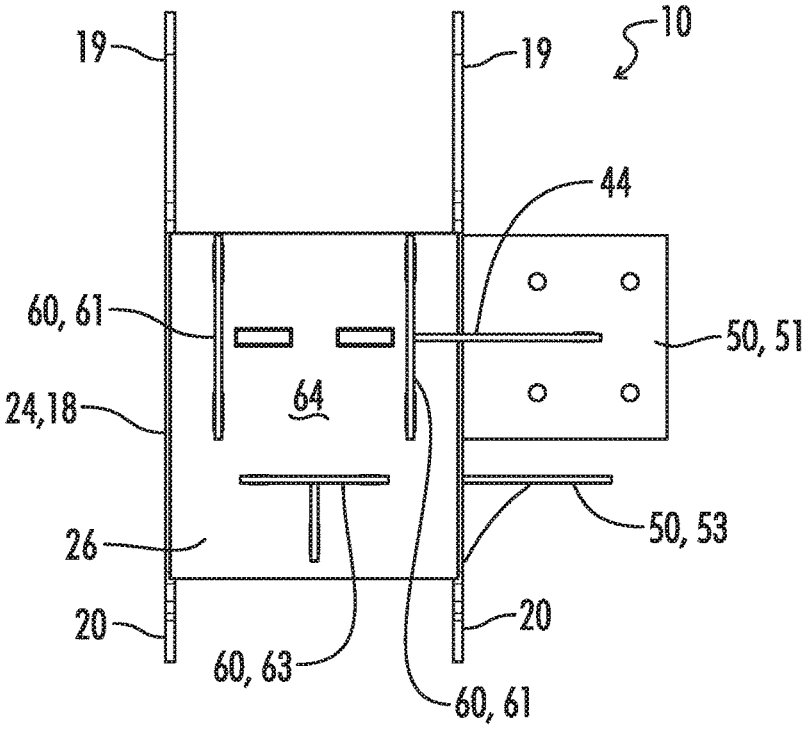
FIG. 4B is a front view of the connection device shown in FIG. 4.
Figure 4C:
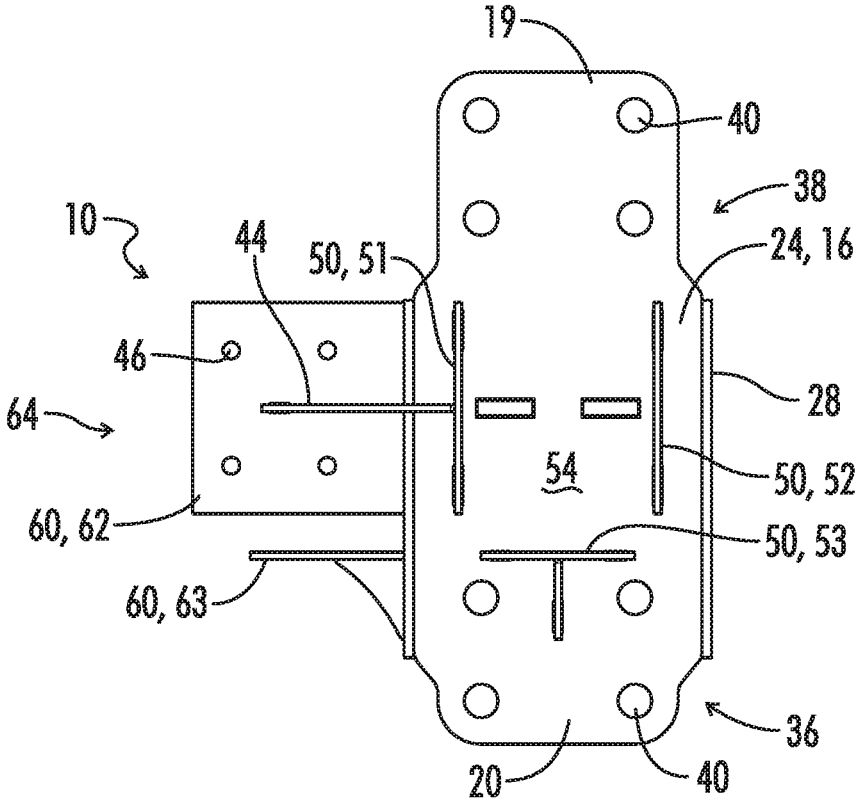
FIG. 4C is a side view of the connection device shown in FIG. 4.
Figure 5:
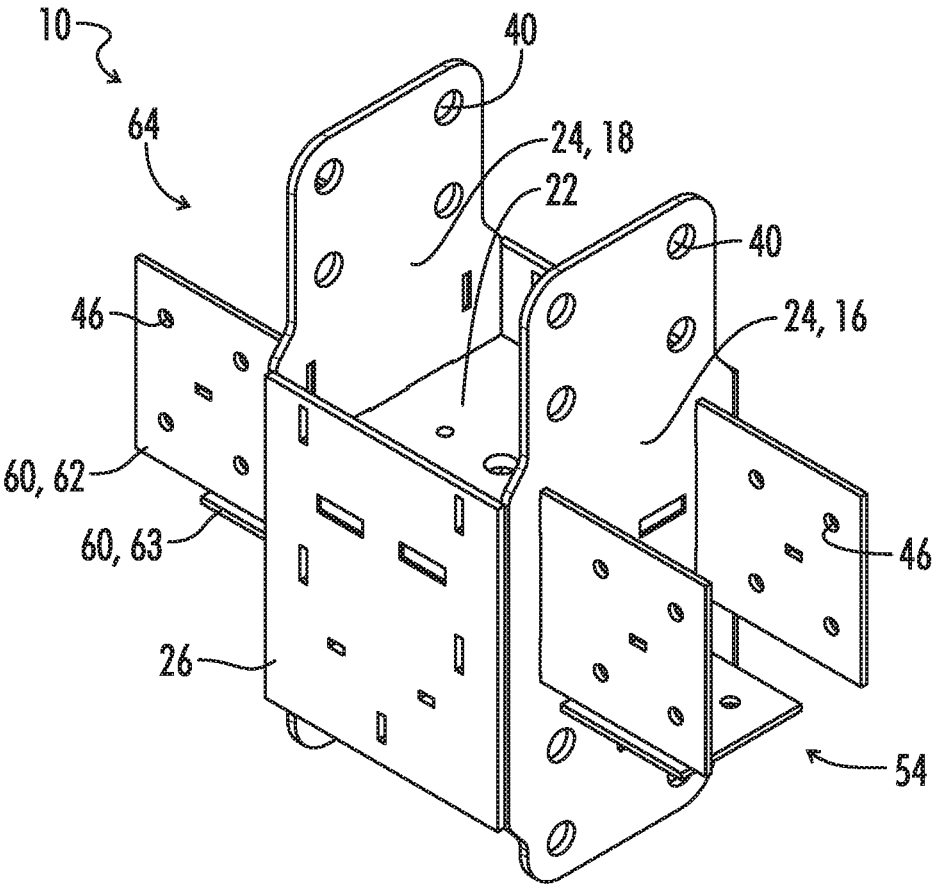
FIG. 5 is a perspective view of an alternate connection device made in accordance with the current disclosure and having two side connection areas.
Figure 5A:
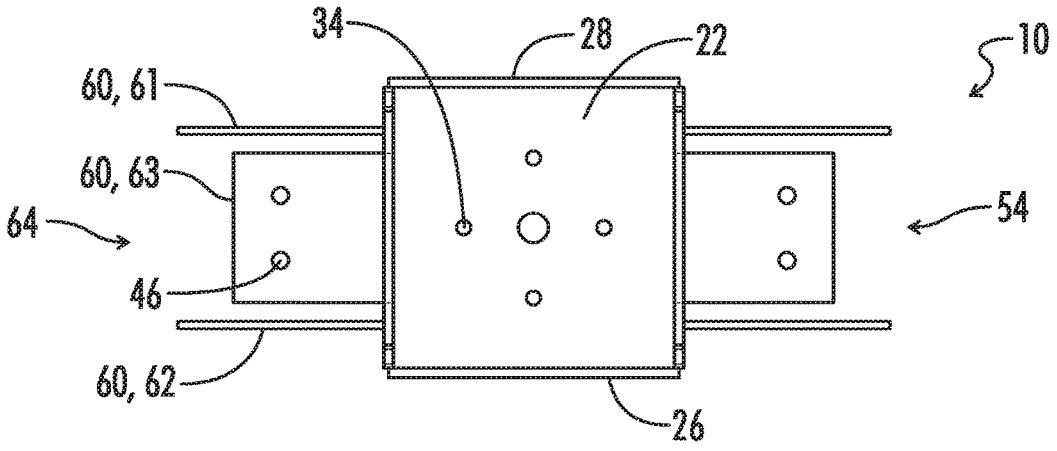
FIG. 5A is a top view of the connection device shown in FIG. 5.
Figure 5B:
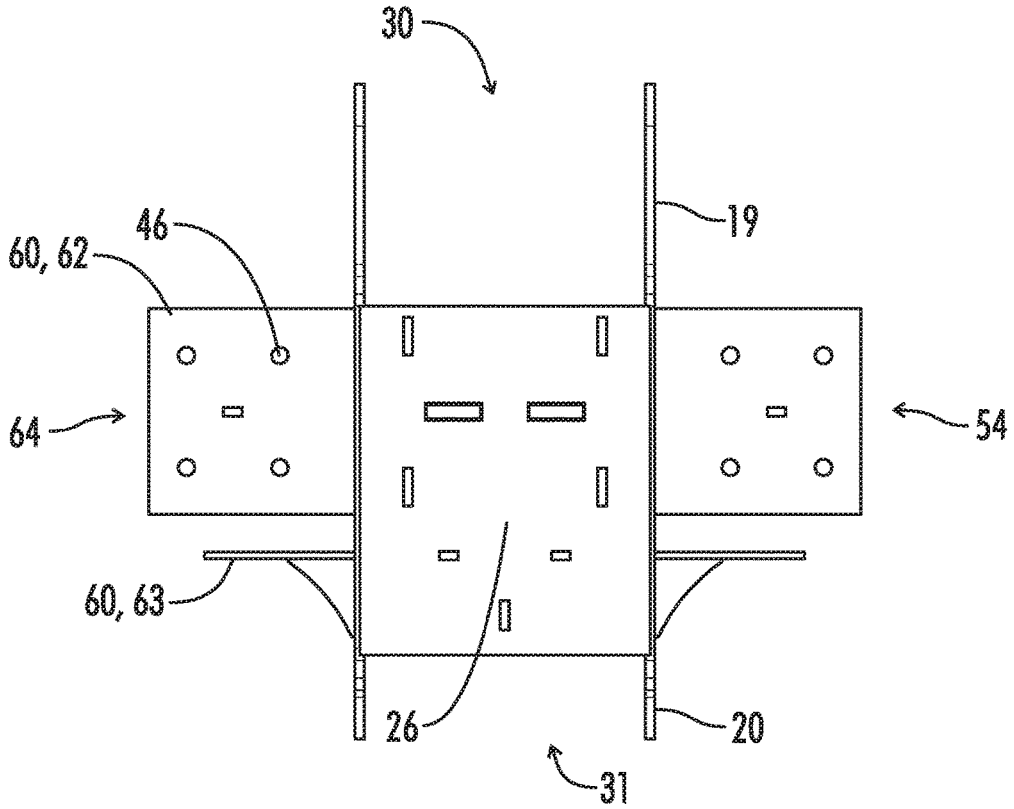
FIG. 5B is a front view of the connection device shown in FIG. 5.
Figure 5C:
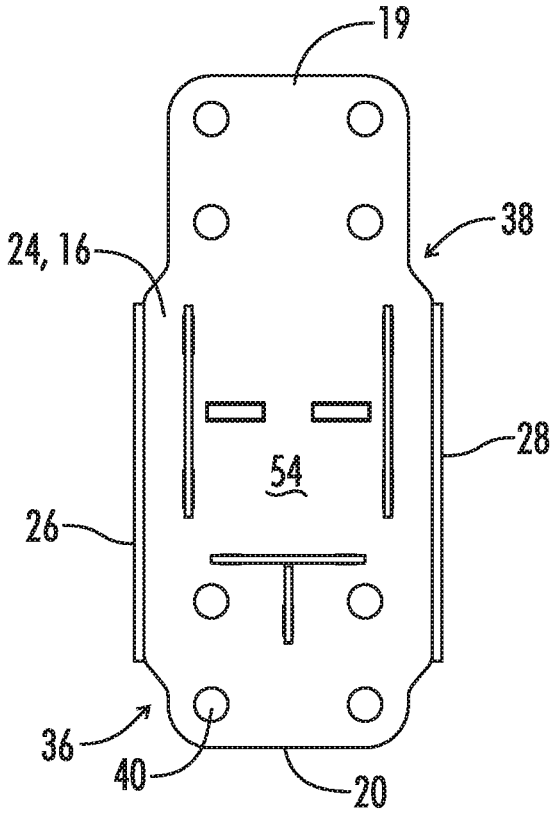
FIG. 5C is a side view of the connection device shown in FIG. 5.
Figure 6:
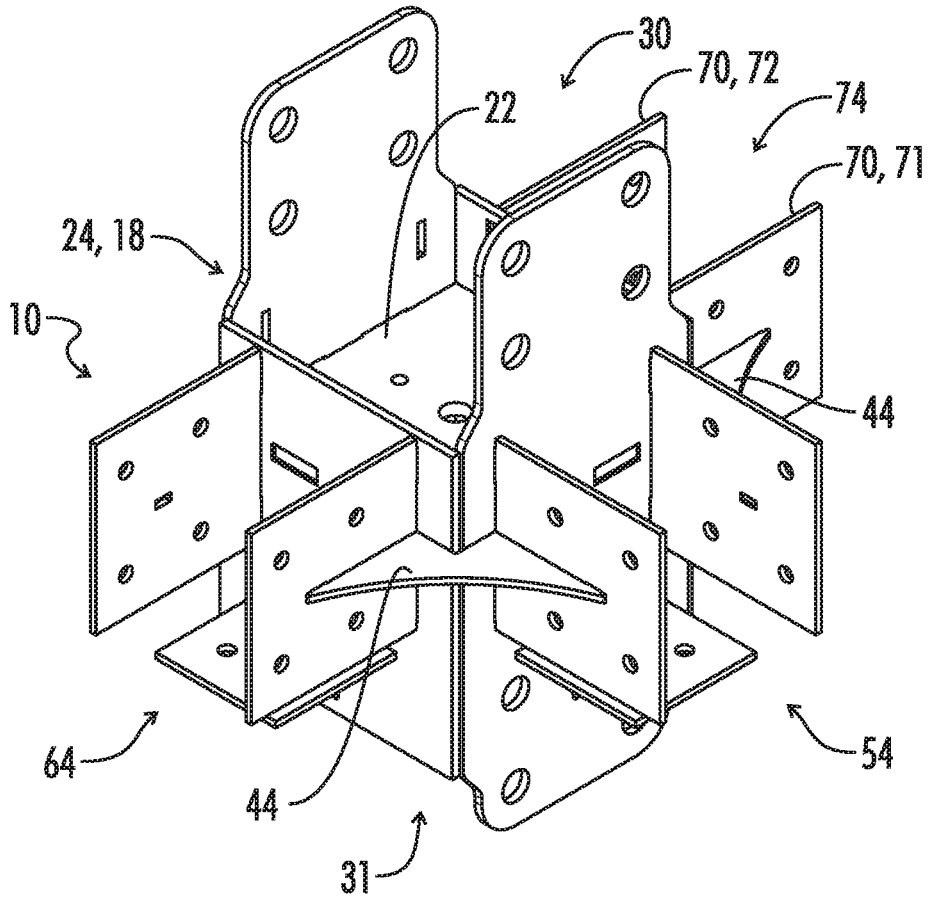
FIG. 6 is a perspective view of a connection device made in accordance with the current disclosure and having three side connection areas.
Figure 6A:
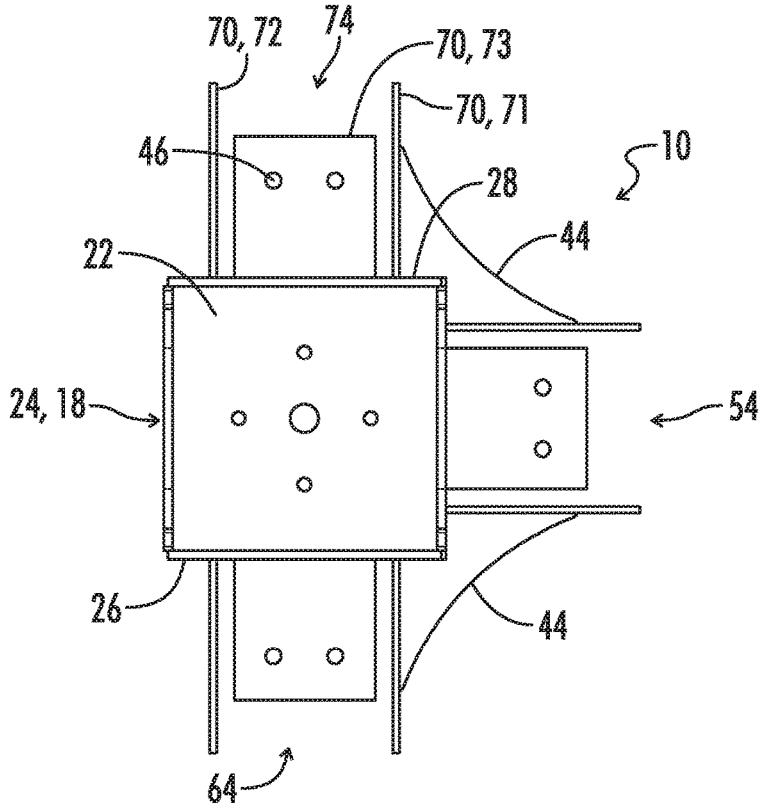
FIG. 6A is a top view of the connection device shown in FIG. 6.
Figure 6B:
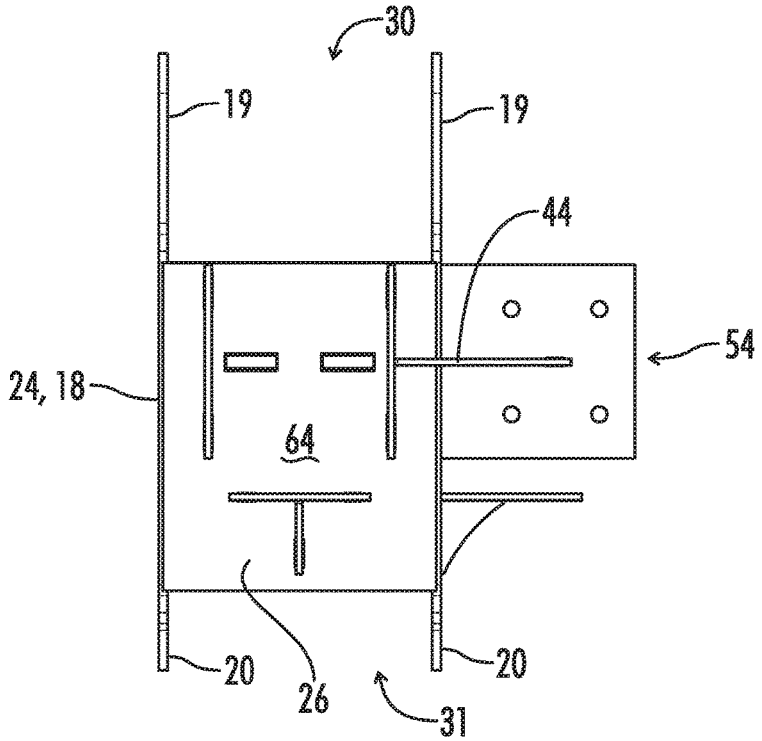
FIG. 6B is a front view of the connection device shown in FIG. 6.
Figure 6C:
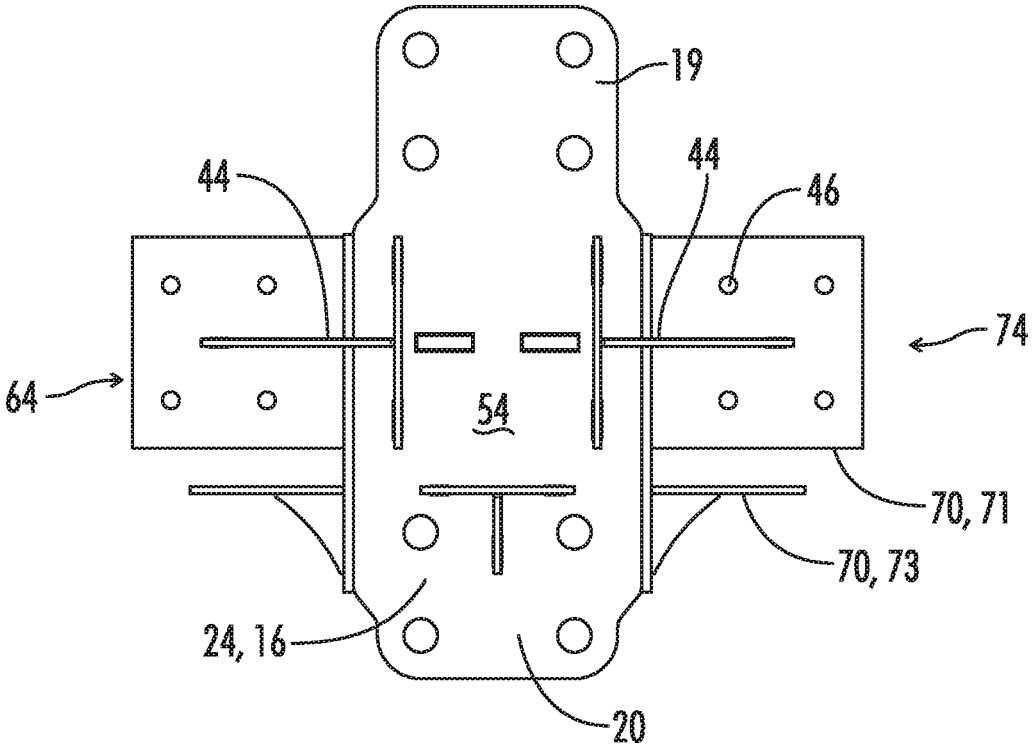
FIG. 6C is a side view of the connection device shown in FIG. 6.
Figure 7:
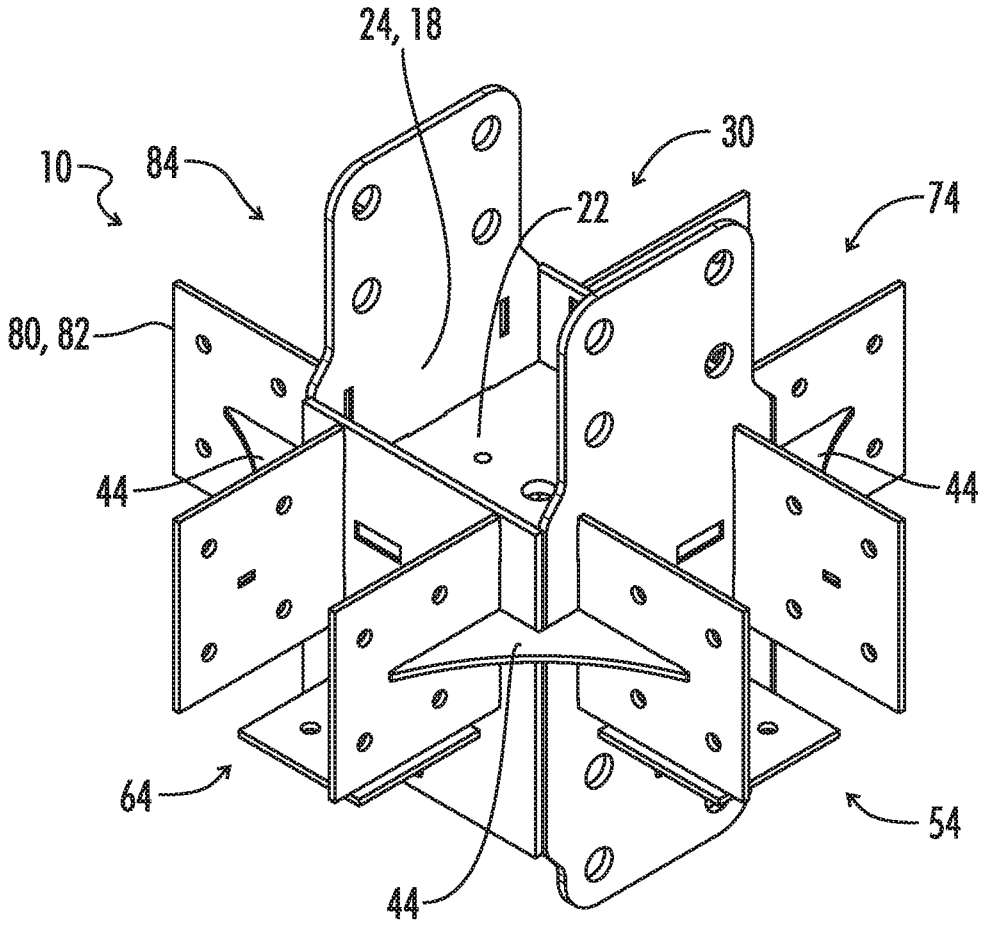
FIG. 7 is a perspective view of a connection device made in accordance with the current disclosure and having four side connection areas.
Figure 7A:
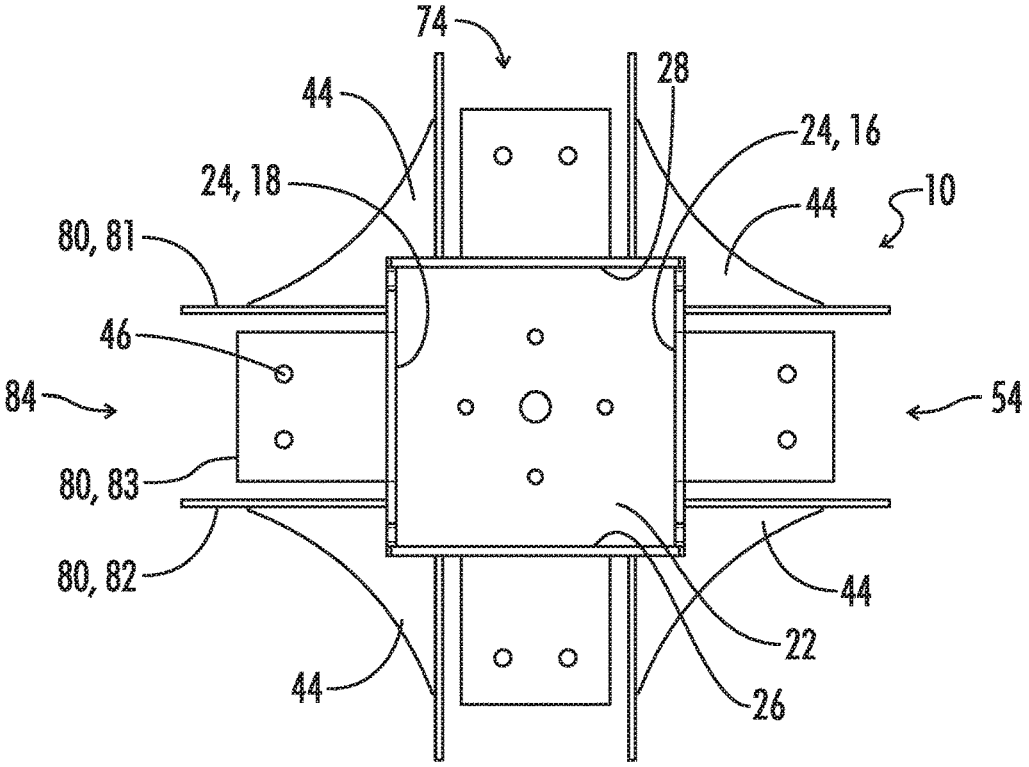
FIG. 7A is a top view of the connection device shown in FIG. 7.
Figure 7B:
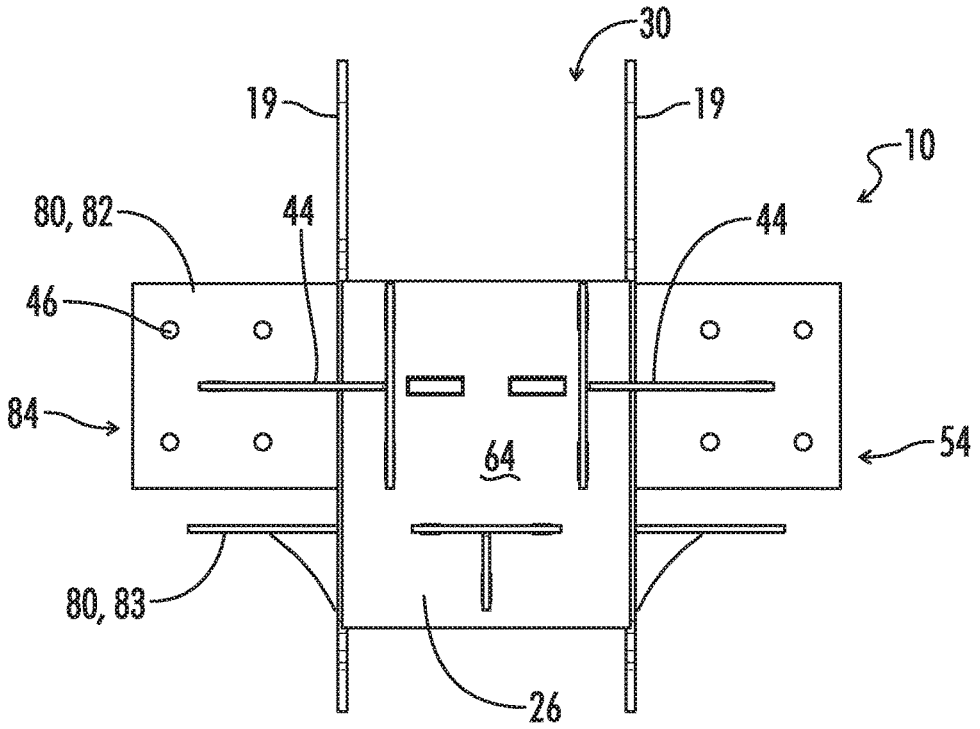
FIG. 7B is a front view of the connection device shown in FIG. 7.
Figure 7C:
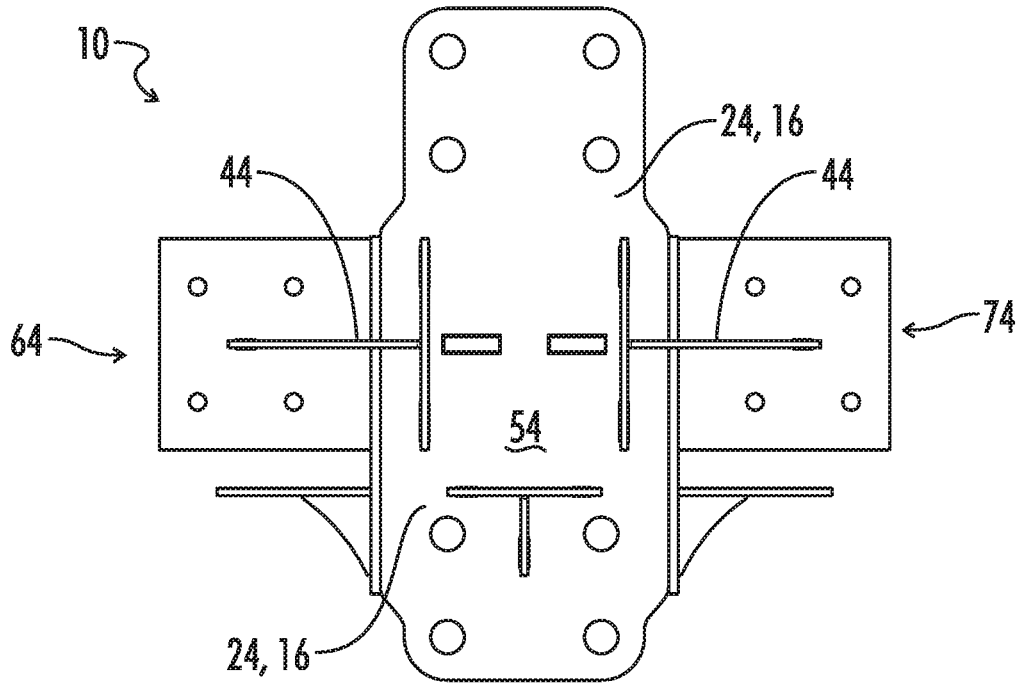
FIG. 7C is a side view of the connection device shown in FIG. 7.
Figure 7D:
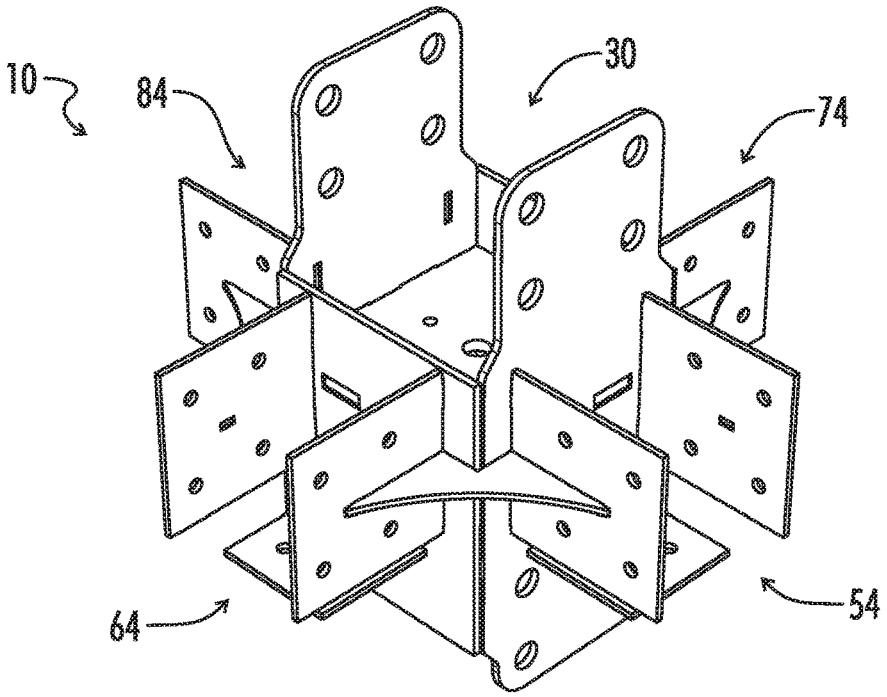
FIG. 7D is an alternate front perspective view of the connection device shown in FIG. 7.
Figure 7E:
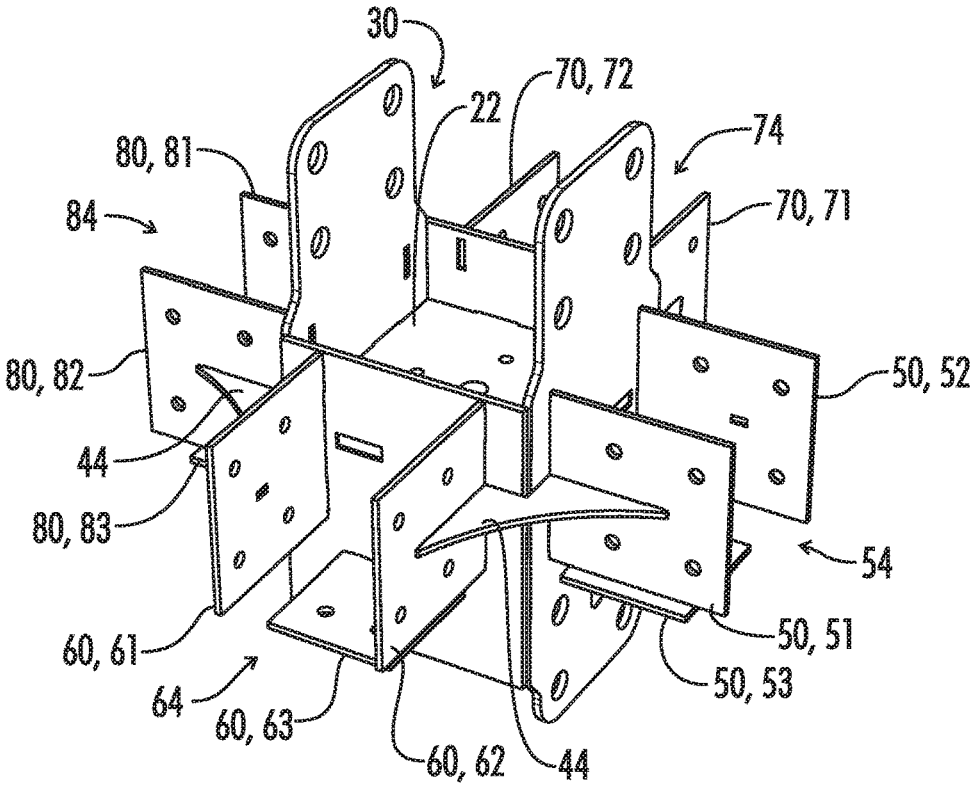
FIG. 7E is another alternate front perspective view of the connection device shown in FIG. 7.
Figure 7F:
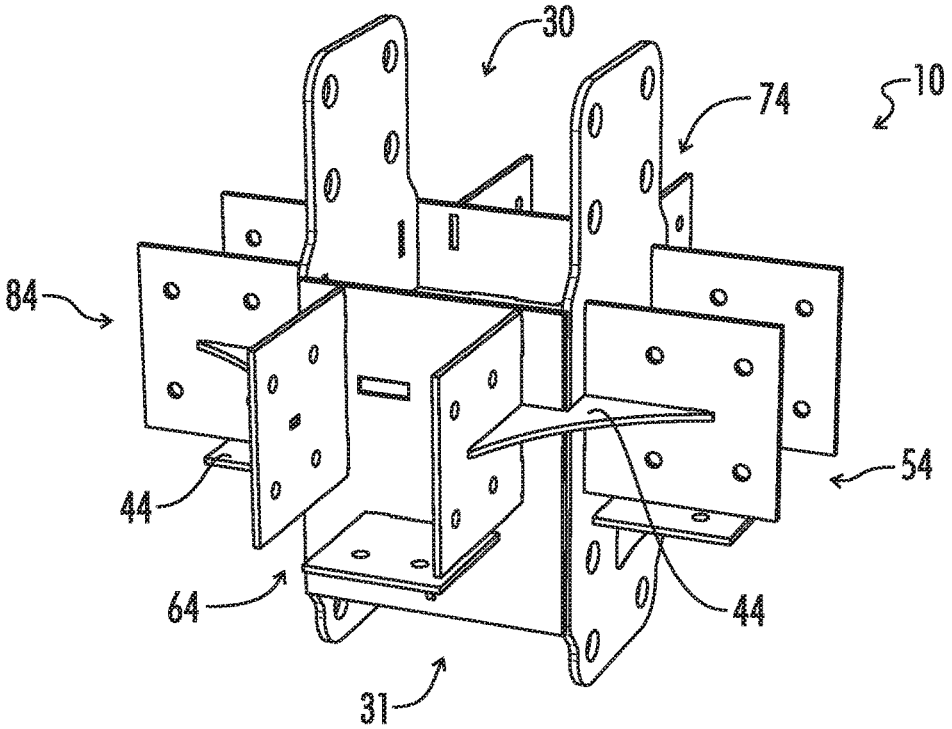
FIG. 7F is another alternate front perspective view of the connection device shown in FIG. 7.
Figure 7G:
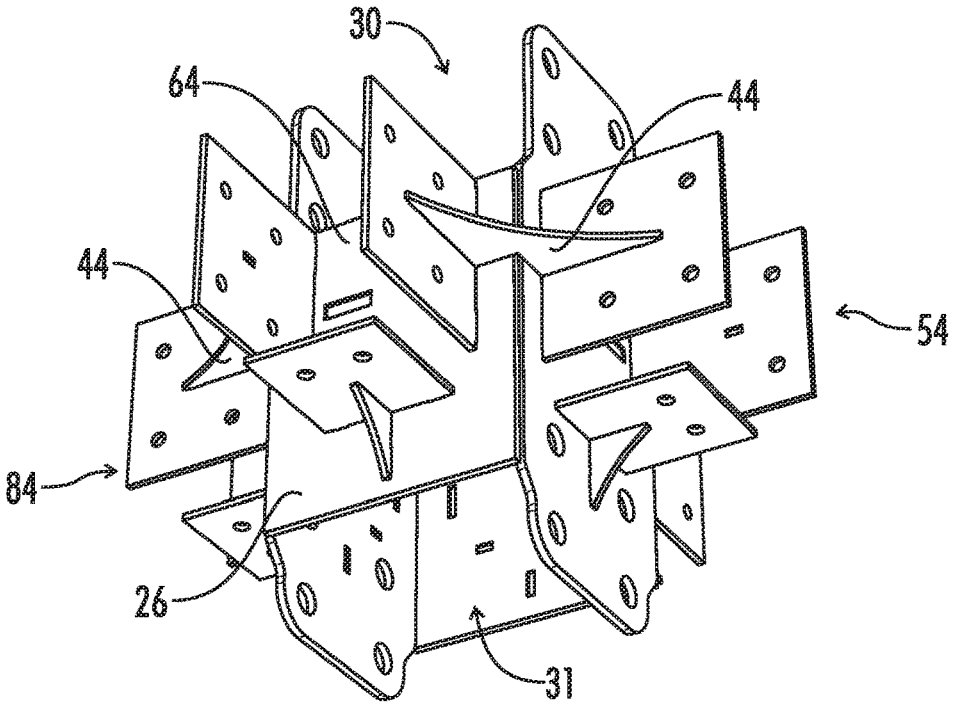
FIG. 7G is a bottom perspective view of the connection device shown in FIG. 7.
Figure 7H:
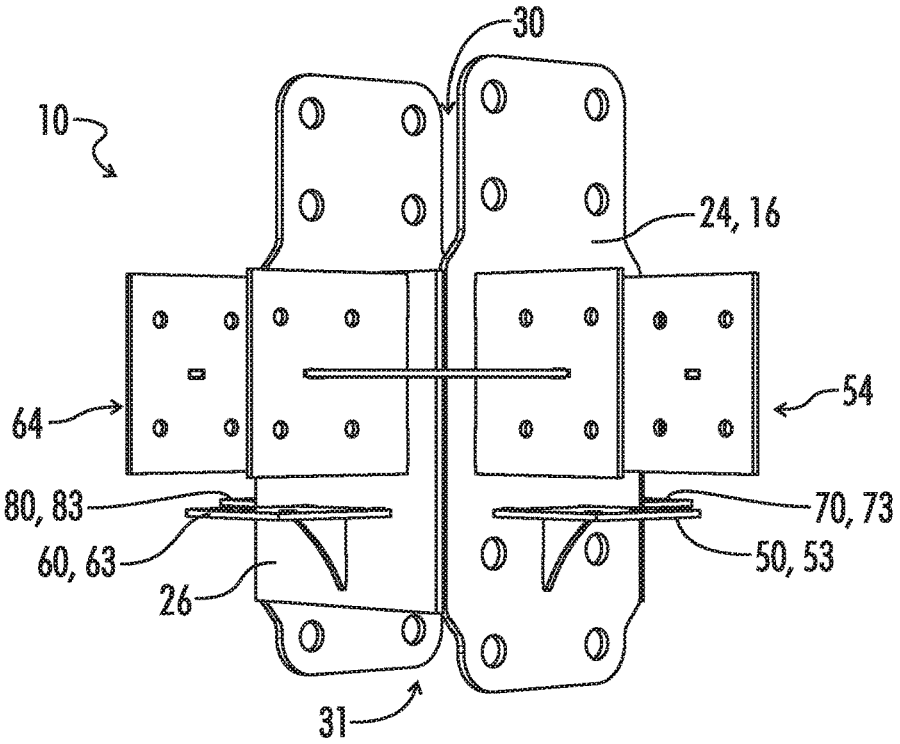
FIG. 7H is a side perspective view of the connection device shown in FIG. 7.
Figure 7I:
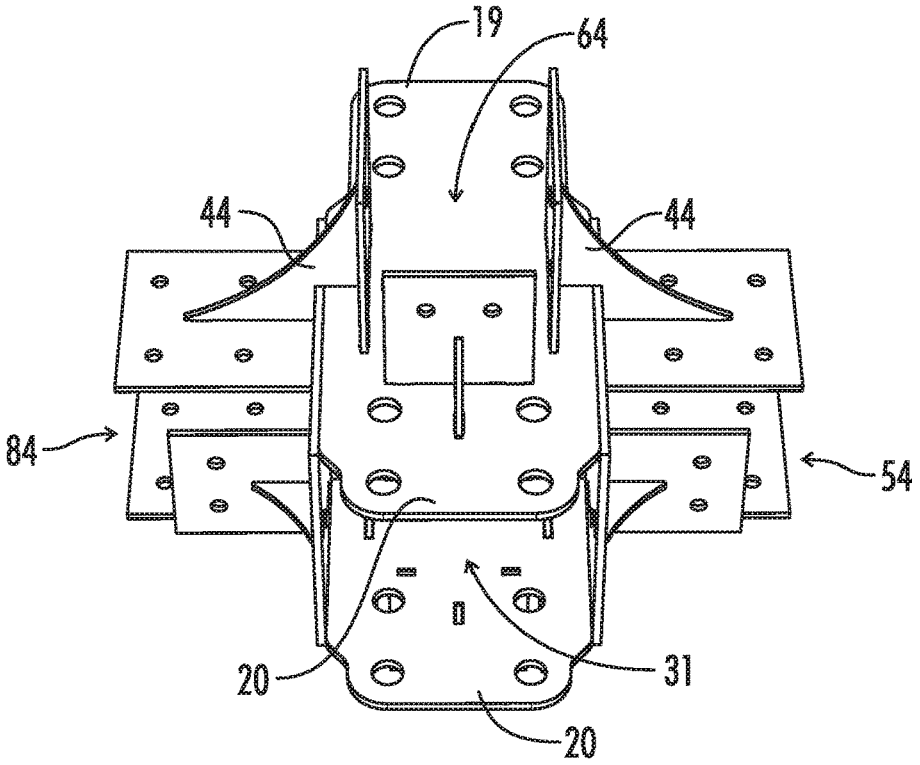
FIG. 7I is an alternate bottom perspective view of the connection device shown in FIG. 7.

Referring generally now to FIGS. 1-7H, a connection device is shown and generally designated by the numeral 10. The connection device 10, which can also be described as a support bracket 10, is for supporting a beam 12. Preferably the connection device connects multiple beams 12 where those beams 12 can be any beam known in the construction industry used to support other structures. For example, the beam 12 can be used to support any structure known in the construction industry. For example, an upper structure, such as a roof or other element above the beam 12, to a lower structure, such as a support surface (e.g., a concrete surface, a support pillar, or a floor) of a building, such as a dwelling, home, and the like. The connection device connects the beams 12 and secures the beams 12 through the connection device 10 at the junction of the beams 12 at the connection device 10. Preferably, the connection device 10 connects multiple wooden beams 12, but each beam 12 can be composed of any known construction material. The connection device 10 may be configured such that it can accept beams 12 in the shape of rectangular prisms.

The connection device 10 includes a plate 22 and a plurality of side supports 24 attached to the plate 22. For example, preferably a first side support 16 and a second side support 18 are attached to the plate 22 and extend from the plate 22 in multiple directions. Preferably, the side supports 24 include a top portion 19 and a bottom portion 20 that extend from the plate 22 in a first direction and a second direction, respectively, with the second direction substantially opposite the first direction (e.g. up and down, left and right, front and back, etc).

A first guide 26 and second guide 28 can both be attached to the plate 22 and extend away from the plate 22. Preferably, the first guide 26 and the second guide 28 are also attached to each side support 24. Each guide 26, 28 can include a top portion 27 extending from the plate 22 in the first direction and a bottom portion 29 extending from the plate 22 in the second direction.

The plate 22, the top portions 19 of the side supports 24, the top portion 27 of the first guide 26, and the top portion 29 of the second guide 28 define a cavity 30 that is shaped to accept one of the beams 12. Further, the plate 22, the bottom portions 20 of the side supports 24, the bottom portion 27 of the first guide 26, and the bottom portion 29 of the second guide 28 define a cavity 32 that is shaped to accept one of the beams 12. These cavities 30 and 32 facilitate attachment of the beams 12 into the connection device 10.

In a preferred embodiment, the plate 22 includes a plurality of plate openings 34. These openings 34 facilitate the attachment of the connection device 10 to the beams 12. For example, the plate openings 34 allow the insertion of fasteners (not shown) through the plate 22 of the connection device 10 into the beams 12. These fasteners can be nut and bolt type fasteners, threaded bars and nuts, nails, or other fasteners as known in the art. In another embodiment, the plate 22 is configured to facilitate the attachment of the connection device 10 to the beams 12 by weakened areas 35 (not shown) instead of openings 34 such that a fastener may be driven through the weakened areas 35. The weakened areas 35 may be formed by, for example, perforating the plate 22 or by constructing a plate to be thin, thus easily pierceable, in a given area.

The top portion 19 of each side support 24 can include at least one indented side 38 and preferably two indented sides 38. The bottom portions 20 of each side support 24 can include at least one indented side 36 and preferably two indented sides 36. The start of the inset of the indented side 38 can begin proximate the plate 22. Alternately, the inset of the indented side 38 can begin proximate either the first guide 26 or second guide 28 depending upon the location of the indented side 38 of the particular side support 24. For each side support 24, the indented sides 38 of the top portion 19 of that side support 24 are longer than the indented sides 36 of the bottom portion 20 of that side support 24.

The side supports 24 can further include a plurality of side support openings 40 that operate with fasteners 42 to secure one of the beams 12 to the side supports 24 and thus the connection device 10 to the beams 12. Preferably the side support openings 40 on oppositely positioned side supports 24 are aligned. This further facilitates the use of fasteners 42 to secure the connection device 10 to one of the beam 12. In another embodiment, the side supports 24 are configured to facilitate the attachment of the connection device 10 to the beams 12 by weakened areas 35 (not shown). The weakened areas 35 may be configured to allow the fastener 46 to pass through them when a driving force is applied. These fasteners 42 can be nut and bolt type fasteners, threaded bars and nuts, nails, or other fasteners as known in the art to secure connection devices and beams.

The connection device can further include a first set 50 of first, second, and third side attachments 51, 52, and 53, respectively. Each side attachment 51, 52, and 53 extends from one of the side supports 24 in a direction substantially perpendicular to that side support 24 and forms a first side connection area 54. The connection can also including a second set 60 of first, second, and third side attachments 61, 62, and 63, respectively. Each side attachment 61, 62, and 63 extends from the other side support 24 in a direction substantially perpendicular to that side support 24 and forms a second side connection area 64.

In an alternate embodiment, the second set 60 of first, second, and third side attachments 61, 62, and 63 can be attached to one of the guides 26 or 28 in a direction substantially perpendicular to that guide 26 or 28 and forms a second side connection area 64 at that location. This embodiment can further include a third set 70 of first, second, and third side attachments 71, 72, and 73, respectively. Each side attachment 71, 72, and 73 extends from the other guide 26 or 28 in a direction substantially perpendicular to that guide 26 or 28 and forms a third side connection area 74. This embodiment can also further include a fourth set 80 of first, second, and third side attachments 81, 82, and 83, respectively. Each side attachment 81, 82, and 83 extends from the other side support 24 in a direction substantially perpendicular to that side support 24 and forms a fourth side connection area 84.

The first, second, third and fourth sets 50, 60, 70, and 80 of side attachments are positioned to accept a beam 12 to facilitate attachment of one of the beams 12 to the connection device 10. For example, the first, second, third, and fourth side connection areas 54, 64, 74, and 84 are shaped to individually accept one of the beams 12. The adjacent side attachments of the first, second, third and fourth sets 50, 60, 70 and 80 of side attachments can include a reinforcement 44 to further facilitate positioning of these side attachments and support of the beams 12 positioned in those adjacent side connection areas.

The first, second, third, and fourth sets 50, 60, 70 and 80 of side attachments can further include a plurality of openings 46 that operate with fasteners 43 to secure one of the beams 12 to that side connection area and thus the connection device 10 to one of the beams 12. Preferably the side support openings 46 on oppositely positioned first and second side attachments 51, 52; 61, 62; 71, 72; or 81, 82 are aligned. This further facilitates the use of fasteners 46 to secure the connection device 10 to one of the beam 12. In another embodiment, first, second, third, and fourth sets 50, 60, 70 and 80 of side attachments are configured to facilitate the attachment of the connection device 10 to the beams 12 by weakened areas 35 (not shown). The weakened areas 35 may be configured to allow the fastener 46 to pass through them when a driving force is applied. These fasteners 46 can be nut and bolt type fasteners, threaded bars and nuts, nails, or other fasteners as known in the art to secure connection devices and beams.

The number of openings, including plate openings 34, side support openings 40, and openings 46 in the sets 50, 60, 70, and 80 of side supports can vary as desired. Preferably there are enough openings in the particular area to properly secure the connection device 10 to one of the beam 12 without having too many of these openings so as to interfere with the actual structural integrity of the connection device 10.

Thus, although there have been described particular embodiments of the present invention of a new and useful Multiple Port Beam Bracket it is not intended that such references be construed as limitations upon the scope of this invention except as set forth in the following claims.

What is claimed is:

1. A connection device for supporting a plurality of beams comprising:

a plate having a plate width and a plate length;

a first side support and a second side support oriented substantially perpendicular to the plate, each side support having a side support height substantially perpendicular to the plate width and the plate length and a side support width substantially parallel to the plate width, each side support including a top portion extending above the plate and a bottom portion extending below the plate;

a first guide and a second guide opposite the first guide, each guide having a guide height substantially parallel to the first and second side support heights, each guide attached to the plate and each side support, each guide including a top portion extending above the plate and a bottom portion extending below the plate;

wherein the first guide and the second guide are oriented substantially perpendicular to the plate, the first side support and the second side support, wherein the plate extends between the first guide and the second guide and between the first side support and the second side support, wherein the plate, the top portion of each side support, and the top portion of each guide define a top cavity shaped to accept one of the beams;

wherein the plate, the bottom portion of each side support, and the bottom portion of each guide define a bottom cavity shaped to accept one of the beams, wherein the top cavity has an open top and further wherein the bottom cavity has an open bottom.

2. The connection device of claim 1, wherein the plate includes a plurality of plate openings.

3. The connection device of claim 1, wherein:

the top portion of each side support includes at least two indented sides;

the bottom portion each side support includes at least two indented sides; and for each side support, the indented sides of the top portion of said side support are longer than the indented sides of the bottom portion of said side support.

4. The connection device of claim 1, wherein each side support includes a plurality of round fastener holes extending through the respective side support.

5. The connection device of claim 1, further including a first set of first, second, and third side attachments, each side attachment extending from one of the side supports in a direction substantially perpendicular to the height of said side support and forming a first side connection area.

6. The connection device of claim 5, further including a second set of first, second, and third side attachments, each side attachment extending from the other side support in a direction substantially perpendicular to the height of said side support and forming a second side connection area.

7. The connection device of claim 5, further including a second set of first, second, and third side attachments, each side attachment extending from one of the guides in a direction substantially perpendicular to the height of said guide and forming a second side connection area, wherein the connection device further comprises a brace extending between a side attachment of the first set and a side attachment of the second set, and further wherein the brace is connected to a guide and a side support.

8. The connection device of claim 7, further including a third set of first, second, and third side attachments, each side attachment extending from the other guide in a direction substantially perpendicular to the height of said guide and forming a third side connection area.

9. The connection device of claim 5 wherein an upper beam is positioned in the upper cavity, wherein a bottom beam is positioned in the bottom cavity, wherein a side beam is positioned between the first, second, and third side attachments, wherein an upper fastener is positioned through the top portion of at least one side support and into the upper beam, wherein a lower fastener is positioned through the bottom portion of at least one side support and into the bottom beam and further wherein a side fastener is positioned through at least one of the first, second, and third side attachments and into the side beam.

10. The connection device of claim 1 wherein a bottom beam is positioned in the bottom cavity, wherein an upper beam is positioned in the upper cavity, wherein an upper fastener is positioned through the top portion of at least one side support and into the upper beam, and further wherein a lower fastener is positioned through the bottom portion of at least one side support and into the bottom beam.

11. The connection device of claim 1 wherein the upper cavity and the bottom cavity are hollow.

12. The connection device of claim 1 wherein the first and second side support top portions comprise at least one aligned fastener hole and further wherein the first and second side support bottom portions comprise at least one aligned fastener hole.

13. The connection device of claim 1 wherein the top and bottom portion of each side support includes at least one round fastener hole extending through the respective side support.

14. The connection device of claim 13 wherein the heights of the first and second side supports are greater than the heights of the first and second guides.

15. A support bracket for supporting a plurality of beams comprising:

a plate having a plate width and a plate length;

a first side support and a second side support oriented substantially perpendicular to the plate, each side support having a side support height substantially perpendicular to the plate width and the plate length and a side support width substantially parallel to the plate width, each side support including a top portion extending above the plate and a bottom portion extending below the plate, wherein the top portion and the bottom portion of each side support includes at least one indented side, wherein, due to the at least one indented side, each side support comprises a variable width;

a first guide and a second guide opposite the first guide, each guide having a guide height substantially parallel to the first and second side support heights, each guide attached to the plate and each side support, each guide including a top portion extending above the plate and a bottom portion extending below the plate;

wherein the first guide and the second guide are oriented substantially perpendicular to the plate, the first side support and the second side support, wherein the plate extends between the first guide and the second guide and between the first side support and the second side support, wherein the plate, the top portion of each side support, and the top portion of each guide define a top cavity shaped to accept one of the beams;

wherein the plate, the bottom portion of each side support, and the bottom portion of each guide define a bottom cavity shaped to accept one of the beams;

wherein the top cavity has an open top and further wherein the bottom cavity has an open bottom.

16. The support bracket of claim 15, wherein each side support includes a plurality of round fastener holes extending through the respective side support.

17. The support bracket of claim 15, wherein the indention on each side support are positioned proximate either the first guide or the second guide.

18. The support bracket of claim 15, wherein for each side support, the at least one indented side of the top portion of said side support is longer than the at least one indented side of the bottom portion of said side support.

19. The support bracket of claim 15, further including a first set of first, second, and third side attachments, each side attachment extending from one of the side supports in a direction substantially perpendicular to said side support and forming a first side connection area, wherein an upper beam is positioned in the upper cavity, wherein a bottom beam is positioned in the bottom cavity and further wherein a side beam is positioned between the first, second, and third side attachments.

20. The support bracket of claim 19, further including a second set of first, second, and third side attachments, each side attachment extending from the other side support in a direction substantially perpendicular to the height of said side support and forming a second side connection area.

21. The support bracket of claim 19, further including a second set of first, second, and third side attachments, each side attachment extending from one of the guides in a direction substantially perpendicular to the height of said guide and forming a second side connection area.

22. The support bracket of claim 21, further including a third set of first, second, and third side attachments, each side attachment extending from the other guide in a direction substantially perpendicular to the height of said side guide and forming a third side connection area.

23. The support bracket of claim 19 wherein an upper beam is positioned in the upper cavity, wherein a bottom beam is positioned in the bottom cavity, wherein a side beam is positioned between the first, second, and third side attachments, wherein an upper fastener is positioned through the top portion of at least one side support and into the upper beam, wherein a lower fastener is positioned through the bottom portion of at least one side support and into the bottom beam and further wherein a side fastener is positioned through at least one of the first, second, and third side attachments and into the side beam.

24. A support bracket for supporting a plurality of beams comprising:

a plate including a plurality of plate openings, the plate having a plate width and a plate length substantially perpendicular to the plate width;

a first side support and a second side support oriented substantially perpendicular to the plate, each side support having a side support height substantially perpendicular to the plate width and the plate length and a side support width substantially parallel to the plate width, each side support including at least one round fastener hole extending through the respective side support, a top portion extending above the plate and a bottom portion extending below the plate, wherein the top portion and the bottom portion of each side support includes at least two indented sides, wherein, due to the at least two indented sides, each side support comprises a variable width;

a first guide and a second guide opposite the first guide, each guide having a guide height substantially parallel to the first and second side support heights, each guide attached to the plate and each side support, each guide including a top portion extending above the plate and a bottom portion extending below the plate;

wherein the first guide and the second guide are oriented substantially perpendicular to the plate, the first side support and the second side support;

wherein the plate extends between the first guide and the second guide and between the first side support and the second side support, wherein for each side support, the indented sides of the top portion of said side support are longer than the indented sides of the bottom portion of said side support;

wherein the plate, the top portion of each side support, and the top portion of each guide define a top cavity shaped to accept one of the beams;

wherein the plate, the bottom portion of each side support, and the bottom portion of each guide define a bottom cavity shaped to accept one of the beams wherein the top cavity has an open top; and further wherein the bottom cavity has an open bottom.

25. The support bracket of claim 24, further including a first set of first, second, and third side attachments, each side attachment extending from one of the side supports in a direction substantially perpendicular to the height of said side support and forming a first side connection area.

26. The support bracket of claim 25, further including a second set of first, second, and third side attachments, each side attachment extending from the other side support in a direction substantially perpendicular to the height of said side support and forming a second side connection area.

27. The support bracket of claim 25, further including a second set of first, second, and third side attachments, each side attachment extending from one of the guides in a direction substantially perpendicular to the height of said guide and forming a second side connection area.

28. The support bracket of claim 27, further including a third set of first, second, and third side attachments, each side attachment extending from the other guide in a direction substantially perpendicular to the height of said side guide and forming a third side connection area.

29. The support bracket of claim 25 wherein an upper beam is positioned in the upper cavity, wherein a bottom beam is positioned in the bottom cavity, wherein a side beam is positioned between the first, second, and third side attachments, wherein an upper fastener is positioned through the top portion of at least one side support and into the upper beam, wherein a lower fastener is positioned through the bottom portion of at least one side support and into the bottom beam and further wherein a side fastener is positioned through at least one of the first, second, and third side attachments and into the side beam.

* * * * *